United States Patent [19]

Watermann et al.

[11] Patent Number: 4,557,635

[45] Date of Patent: Dec. 10, 1985

[54] SHIELD-TYPE SUPPORT FRAME

[75] Inventors: Willy Watermann; Winfried Hachenberg, both of Dortmund, Fed. Rep. of Germany

[73] Assignee: Klockner-Becorit GmbH, Castrop-Rauxel, Fed. Rep. of Germany

[21] Appl. No.: 556,186

[22] Filed: Nov. 29, 1983

[30] Foreign Application Priority Data

Dec. 1, 1982 [DE] Fed. Rep. of Germany ..... 3244438

[51] Int. Cl.[4] ..... E21D 15/44

[52] U.S. Cl. ..... 405/296; 405/297

[58] Field of Search ..... 405/291, 294, 295, 296, 405/297; 299/33

[56] References Cited

U.S. PATENT DOCUMENTS

| | | | |
|---|---|---|---|
| 4,118,939 | 10/1978 | Saunders | 405/296 |
| 4,132,081 | 1/1979 | Walker et al. | 405/296 |
| 4,191,497 | 3/1980 | Poklekowski et al. | 405/296 |
| 4,293,247 | 10/1981 | Rosenberg et al. | 405/296 |

FOREIGN PATENT DOCUMENTS

| | | | |
|---|---|---|---|
| 3038629 | 5/1982 | Fed. Rep. of Germany | 405/296 |
| 1533981 | 11/1978 | United Kingdom . | |

*Primary Examiner*—David H. Corbin

*Attorney, Agent, or Firm*—Collard, Roe & Galgano

[57] ABSTRACT

A shield-type support frame for serving as a face support in underground mining operations having a bottom structure, a one-piece roof cap, at least one hydraulic plunger connecting the bottom structure and the roof cap and two shield elements arranged side by side, which can be adjusted in height separately and which are each pivotally connected to the bottom structure and the roof cap. Joint connections between each shield element and the roof cap permit tilting of the roof cap relative to the shield elements about axes extending in the forward direction. In such a shield-type support frame, the roof cap is guided better in the forward direction and tilting of the roof cap about a vertical axis is prevented by the joint connections between the shield elements and the roof cap each having a hinge connection with two hinge pins of which the one extends in the face length direction and the other in the forward direction, where the roof cap is supported by the hinge pins extending in the forward direction and the shield elements by the hinge pins extending in the face length direction.

2 Claims, 2 Drawing Figures

SHIELD-TYPE SUPPORT FRAME

Figure 1:
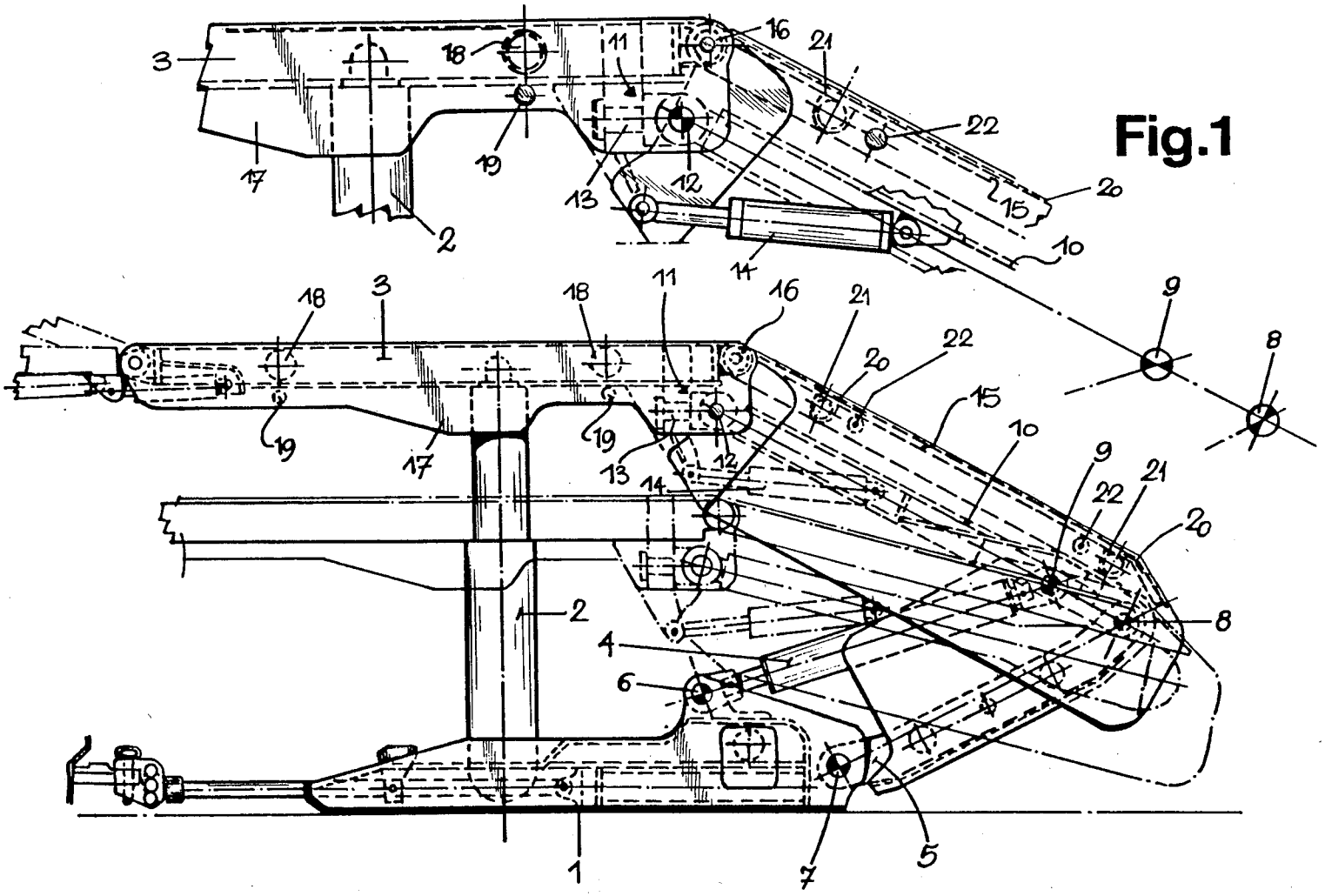

The present invention relates generally to a support frame for serving as a face support in underground mining operations. More particularly, the present invention relates to a shield-type support frame, with a bottom structure, a one-piece roof cap, at least one hydraulic plunger between the bottom structure and the roof cap, and two shield elements arranged side by side which can be separately adjusted in height and which are each pivotally connected to the bottom structure and the roof cap. The joints between each shield element and the roof cap permit pivoting of the roof cap relative to the shield elements about pivot axes extending in the forward direction.

Such shield-type support frames have the advantage that the roof cap can pivot about an axis extending in the direction of movement and can therefore adapt itself to possible irregularities in the roof of the seam. In a shield-type support frame of the type mentioned, as is known according to the state of the art (DE-AS 26 15 629), the joints between the two shield elements and the roof cap are respectively designed as universal joints in the form of ball joints which permit rotation of the roof cap relative to the shield elements about any axis. As a result, the danger exists that the entire roof cap can tilt or twist about a vertical axis and run laterally off direction in the subsequent moving operations if a suitable force is exerted thereon.

In the shield-type support frame known from the state of the art, such tilting or twisting of the roof cap about the vertical axis is avoided by providing the two upper ends of the two shield elements with lemniscate guides for guiding them approximately in a straight line in the vertical direction. However, such a guide does not sufficiently prevent twisting of the roof cap about a vertical axis. This is because the ball joints between the shield elements and the seam cap are not stiff against such twisting motions so that considerable twisting of the cap structure about a vertical axis results because of the unavoidable play in the ball joints and the unavoidable elastic deformations of the shield elements in conjunction with the unfavorable lever ratio. This twisting of the roof cap is a hindrance for the further advancement of the shield-type support frame.

It is, therefore, an object of the present invention to further develop the shield-type support frame of the type described above in such a manner that twisting or tilting of the seam cap about the vertical axis is entirely eliminated.

Beginning with a shield-type support frame of the type described above, the above object, as well as others which will hereinafter become apparent, is accomplished in accordance with the present invention in that the joints between the shield elements and the roof cap each have an intermediate joint piece with two pivot pins, of which one extends in the face length direction and the other in the forward direction or direction of movement, wherein the roof cap is supported at pivot pins extending in the direction of movement, and the shield elements at pivot pins extending in the face length direction.

In the shield-type support frame according to the present invention, tilting or twisting of the roof cap about a vertical axis is rendered impossible by the peculiar design of the joints between the upper ends of the shield elements and the seam cap, because the hinge connections proposed according to the invention do not permit rotation about the vertical axis. To the contrary, the roof cap is given exact guidance in the direction of movement by the pivots formed by the hinge connections without hindering the tiltability about an axis extending in the forward direction.

A preferred embodiment of the present invention provides that the shield elements are designed as narrow beams, on which a cover plate rests which is movable relative to these beams and which is connected to the roof cap by a hinge extending in the face length direction. Through the use of such an undivided cover plate which covers both shield elements which are movable relative to each other, sealing difficulties in the region between the two shield elements are avoided. Since the cover plate is also fastened to the seam cap by a hinge, sealing difficulties between the shield elements and the roof cap are avoided. It is advantageous to guide the cover plate at the shield elements with lateral play such that the angle of inclination of the roof cap, which is connected to the cover plate, about the central axis extending in the forward direction is limited toward both sides. In this manner it is possible without appreciable extra cost to prevent an excessive inclination of the cap toward both sides. The shield-type support frame is therefore given additional strength by the cover plate against excessively large lateral inclinations of the roof cap.

In this embodiment of the shield-type support frame according to the present invention, the cover plate is further provided, like the roof cap, with guides extending in the face length direction for laterally extendable gap sealing plates. Thereby, the advantage is obtained that in the event the roof cap is tilted about an axis extending in the forward direction, the gap sealing plates guided at the roof cap are laterally inclined in the same way as the gap sealing plates guided at the cover plate. This would not be the case if the gap sealing plates were guided directly at the shield element, as is customary according to the state of the art. By the measure proposed according to the invention, a lateral guiding surface formed by the gap sealing plates is obtained without any projection or recesses, along which the rectilinearly advancing shield-type support frame is guided without difficulty even if the roof cap has been tilted about an axis extending in the forward direction.

Finally, it is provided that each shield element is guided at the bottom structure via a lemniscate guiding system, the link on the working side of which is designed as a pressure medium or hydraulic cylinder which can be fixed hydraulically at a given extension length and can be extended or shortened if a given axial force is exceeded. This lemniscate guidance system with links which give way if a given load is exceeded, prevents the shield elements and the links guiding them from being overloaded if excessive horizontal forces acting on the roof cap occur or if the roof cap is heavily inclined laterally.

Figure 2:
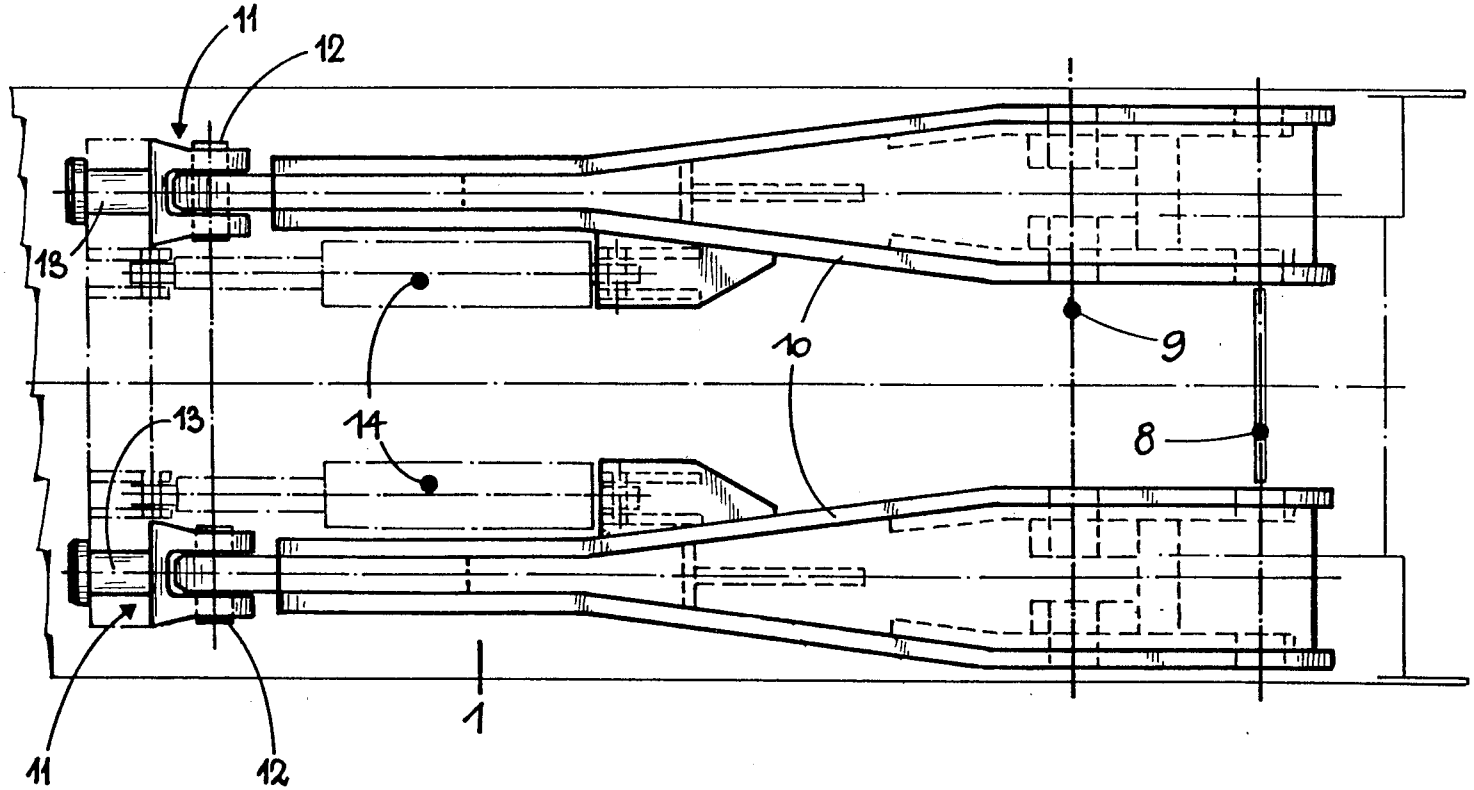

The present invention will be described and understood more readily when considered together with the embodiment depicted in the accompanying drawings, in which:

FIG. 1 is a side elevational view of a shield-type support frame according to the present invention; and FIG. 2 is a top view of the two shield elements of the shield-type support frame.

As seen in FIG. 1, the bottom structure of the shield-type support frame resting on the floor is designated with the reference numeral 1. On bottom structure 1 a plunger 2 is movably supported in all directions. Plunger 2 flexibly supports a one-piece roof cap 3 in all directions.

To the end of bottom structure 1 on the stowing side, two lemniscate guiding systems are fastened side by side, as seen in the face length direction, each having a link 4 on the working side and a link 5 on the stowing side. Links 4 and 5 are pivotal on bottom structure 1 about axes 6 and 7 extending in the face length direction and are pivotal on shield elements 10, adjacently arranged in the face length direction, about axes 8 and 9. Links 4 on the working side are designed as pressure medium or hydraulic cylinders which can be fixed hydraulically at a given extended length and can be lengthened or shortened if a given axial force acting on them is exceeded. Links 5 on the stowing side, on the other hand, are designed as rigid guide bars.

Shield elements 10, arranged side by side as seen in the face length direction as clearly shown in FIG. 2, are designed as narrow beams which become wider downwardly for the purpose of a stable support at links 4 and 5 of the lemniscate guiding systems. At their upper end, shield elements 10 are each connected to the roof cap 3 via a connecting joint. Each of these connecting joints includes a hinge connection 11 with two hinge pins 12 and 13. Hinge pin 12 extends in the face length direction and serves as the connection of the upper end of the associated shield element 10. Hinge pin 13 extends in the forward direction and serves as the connection of the roof cap 3. The joints with the hinge connections 11 designed in this manner permit tilting or twisting of the roof cap 3 relative to shield elements 10 about axes extending in the face length direction and in the forward direction, but not about a vertical axis. It is assured in this manner that the roof cap is guided taut in the forward direction and cannot run off.

Between each shield element 10 and the roof cap 3 there are further provided corner cylinders 14, as seen in FIG. 2, which additionally serve to stabilize roof cap 3 relative to shield elements 10.

For protection against a cave-in or falling dirt, a cover plate 15 is placed on the shield elements 10. This plate is movable relative to shield elements 10 and is fastened by a hinge to the stowing side end of roof cap 3 by a hinge 16 with an axis extending in the face length direction. Cover plate 15 is guided at shield element 10 with much lateral play in such a way that the angle, by which roof cap 3 can be inclined laterally about an axis extending in the forward direction, is limited toward both sides, for instance, to 15°. In this manner, cover plate 15 prevents excessive lateral angles of inclination of roof cap 3 through support at the shield elements 10.

Gap sealing plates 17, which can be extended laterally in a manner known per se, are fastened to the roof cap 3. These gap sealing plates 17 are guided in guides 18 extending in the face length direction and can be extended laterally by means of pressure medium or hydraulic cylinders 19. In the same manner laterally extendable gap sealing plates 20 are also fastened to cover plate 15 and are guided in guides 21 extending in the face length direction and can be extended laterally by means of pressure medium or hydraulic cylinders 22. Since cover plate 15 and guides 21 fastened thereto participate in the lateral inclinations of the roof cap 3 because of the fastening thereto, gap sealing plates 17 and 20 of roof cap 3 and of cover plate 15, respectively, remain always in the same plane even if the roof cap 3 is inclined laterally. This would not be the case if gap sealing plate 20 were fastened to the shield elements 10, as is customary according to the state of the art. By the manner proposed in accordance with the invention, difficulties in guiding and supporting the adjacent shield-type support frame at the seam between the gap sealing plates 17 and 20 of the roof cap 3 and the cover plate 15 are avoided.

Resolving the entire shield structure, as proposed in the invention, into a cover element in the form of the cover plate 15 and into force transmission elements in the form of shield elements 10 in conjunction with resilient links 4 of the lemniscate guidance system has the advantage that one gets along with considerably smaller overall weights as compared to the state of the art while the operation is improved, because the force transmission elements can give way to excessive loads if the support frame is set, and therefore need to be made only so heavy that they can supply sufficiently large guidance forces during the advancing operation. Links 4 of the lemniscate guidance system, which can be extended or shortened hydraulically, have the further advantage that the end of the bottom structure on the working side can be lifted during the advance movement if required.

It is understood that the foregoing general and detailed descriptions are explanatory of the present invention and are not to be interpreted as restrictive of the scope of the following claims:

What is claimed is:

1. A shield-type support frame for a mine roof comprising:

(a) a bottom structure;

(b) a one-piece roof cap;

(c) at least one hydraulic plunger connecting said roof cap to said bottom structure;

(d) two shield elements in the form of narrow beams arranged side by side, each separately adjustable in height relative to the other, said shield elements being pivotally connected to said bottom structure;

(e) a pivotal connection connecting each of said shield elements to said one-piece roof cap which includes a hinge connection having a first hinge pin extending in the face length direction supporting said shield element and a second hinge pin extending in the forward direction supporting said one-piece roof cap, so that said roof cap may be pivoted relative to said shield elements about axes extending in the forward direction; and (f) a cover plate adapted to rest on said shield elements and be movable relative thereto connected to said roof cap by a hinge having a pivot axis extending in the face length direction.

2. A shield-type support frame according to claim 1, wherein each shield element is guided by means of a lemniscate guidance system at the bottom structure, the link of which on the working side is designed as a pressure medium cylinder which can be secured hydraulically in a given extension position and can be extended or shortened if a certain axial force is exceeded.

* * * * *